US010196195B2

(12) United States Patent
Guillon et al.

(10) Patent No.: US 10,196,195 B2
(45) Date of Patent: Feb. 5, 2019

(54) PACKAGING DEVICE DESIGNED TO SEPARATELY PACKAGE A FIRST AND A SECOND FLUID

(75) Inventors: Bruno Guillon, Cannes (FR); Vincent Sebille, Etampes (FR)

(73) Assignee: Cadorit AG, Basel Landschaft (CH)

( * ) Notice: Subject to any disclaimer, the term of this patent is extended or adjusted under 35 U.S.C. 154(b) by 0 days.

(21) Appl. No.: 14/007,863

(22) PCT Filed: Mar. 5, 2012

(86) PCT No.: PCT/FR2012/050450

§ 371 (c)(1),
(2), (4) Date: Dec. 3, 2013

(87) PCT Pub. No.: WO2012/131205

PCT Pub. Date: Oct. 4, 2012

(65) Prior Publication Data

US 2014/0124394 A1 May 8, 2014

(30) Foreign Application Priority Data

Mar. 30, 2011 (FR) ..... 11 52650

(51) Int. Cl.
*B65D 81/32* (2006.01)
*B65D 51/28* (2006.01)

(52) U.S. Cl.
CPC ..... *B65D 81/32* (2013.01); *B65D 81/3211* (2013.01); *B65D 51/28* (2013.01)

(58) Field of Classification Search
CPC ..... B65D 51/2807; B65D 51/2814; B65D 51/2821; B65D 81/32; B65D 81/3205; B65D 81/3211; B65D 81/3222; B65D 51/28; B01F 13/002; B01F 13/0022; B01F 13/0023
USPC ..... 206/222, 219; 220/521, 504
See application file for complete search history.

(56) References Cited

U.S. PATENT DOCUMENTS 3,970,068 A * 7/1976 Sato ..... 126/263.08
5,875,968 A * 3/1999 Miller ..... A61L 9/127 239/44
6,364,103 B1 * 4/2002 Sergio et al. ..... 206/222
7,377,383 B2 * 5/2008 Henry ..... B65D 81/3211 206/222

(Continued)

FOREIGN PATENT DOCUMENTS

DE 199 17 942 A1 10/2000
DE 199 50 884 A1 4/2001
JP 2009 067412 A 4/2009

OTHER PUBLICATIONS

Derrien, Yannick, "International Search Report" for PCT/FR2012/050450, as dated May 11, 2012, 3 pages.

*Primary Examiner* — Robert Poon
(74) *Attorney, Agent, or Firm* — Winstead PC

(57) ABSTRACT

The invention relates to a package for packaging a first fluid and a second fluid, the second fluid being separated from the first, wherein the package comprises a first part for packaging a first fluid and a second part for packaging a second fluid, wherein the first part and the second part are designed to move from a first position, wherein the first part and the second part are separated, to a second position which makes it possible to mix the first fluid and the second fluid.

20 Claims, 4 Drawing Sheets

(56) References Cited

U.S. PATENT DOCUMENTS

| | | | | |
|---|---|---|---|---|
| 8,443,970 | B2 * | 5/2013 | Coon | B65D 51/2835 206/219 |
| 2002/0170834 | A1 * | 11/2002 | Lee et al. | 206/221 |
| 2008/0179334 | A1 * | 7/2008 | Abramson et al. | 220/568 |
| 2010/0163509 | A1 * | 7/2010 | Canziani Hoffa | B65D 47/243 215/228 |
| 2010/0308130 | A1 * | 12/2010 | Gruenbacher | A01M 1/2033 239/34 |
| 2011/0180545 | A1 * | 7/2011 | Marino | B65D 81/3211 220/568 |
| 2012/0006697 | A1 * | 1/2012 | Portier et al. | 206/204 |
| 2012/0279939 | A1 * | 11/2012 | Lee | B65D 51/28 215/227 |

* cited by examiner

PACKAGING DEVICE DESIGNED TO SEPARATELY PACKAGE A FIRST AND A SECOND FLUID

The invention relates to a package for packaging a first fluid and a second fluid, the second fluid being separated from the first, wherein the package comprises a first part for packaging a first fluid and a second part for packaging a second fluid, wherein the first part and the second part are designed to move from a first position, wherein the first part and the second part are separated, to a second position which makes it possible to mix the first fluid and the second fluid.

A device for packaging a first fluid and a second fluid which makes it possible to prevent the two fluids from mixing before use is already known from the prior art. When the product is to be used, the package is handled so as to make it possible for fluids to mix inside said package, thus making it possible for the user to expose the mixture of the two fluids outside the package.

A device of this type is described, inter alia, in document DE19917942. This document discloses a package which comprises a first part designed to contain a first fluid, for example in liquid form. The device comprises a second part designed to contain a second fluid, for example in powdered form.

If the user wishes to use the product mixture inside the package, he first has to move the second part with respect to the first part of the package so as to remove the obstacle between the two compartments and enable mixing between the two fluids contained in the package.

According to DE19917942, the second fluid contained in the second part is covered by a protective layer. The fluid contained in the first part of the package is protected by a removable element designed to be moved from a first, closed position to a second, open position.

This closing element is provided, on the lower side thereof, with a perforator which, when the first part is moved with respect to the second part of the receptacle, can perforate the protective layer which protects the contents of the second part.

A major drawback of the device according to DE19917942 lies in the fact that the element for closing the first part of the package comprises a non-fixed element which, after use, being removable, penetrates the package. Inside this package, the removable element may form an obstacle which can, on the one hand, obstruct optimal mixing of the first fluid and the second fluid and, on the other hand, obstruct proper discharge of said fluids out of the package.

A second drawback, related to the first, lies in the fact that the process of opening the two compartments is not ensured if the closing element of the first compartment is moved to a second position before the opening of the second part has come into effect.

Moreover, the receptacle according to DE19917942 is designed to properly separate the two fluids contained in the device in a first position of said device. In the second position of said device, the fluids contained in the device can be mixed.

The prior art device was developed primarily to provide a mechanism for opening the two receptacles inside the device. No measures were taken to ensure that the fluids contained in the device are packed in an ideal manner. In other words, when the device according to DE19917942 is in storage, the fluids contained in said device may be exposed to the influence of oxygen $O_2$ and $H_2O$, which may penetrate inside the receptacles of the device.

The object of the present invention is to provide a packaging device which makes it possible to package two fluids inside separate compartments, wherein said packaging device is provided with a mechanism making it possible to mix the two fluids, at a time of the user's choosing, whilst avoiding the drawbacks associated with the known prior art device.

According to the invention, the device is designed to optimally protect the fluids contained in said device, each in their respective separate compartments, before the fluids contained in the device are mixed at a time of the user's choosing.

The present invention relates to a device comprising a first part for packaging a first fluid and a second part for packaging a second fluid, wherein the first part and the second part are designed to move from a first position, wherein the first fluid and the second fluid are separated, to a second position which makes it possible to mix the first fluid and the second fluid, wherein the first part is provided with a breakable element, which is designed to be moved by means of a striking element, connected to the second part, from a first position to close the first part to a second position to release the fluid contained in the first part, by moving the first part with respect to the second part, from the first position to the second position, and wherein the second part is provided with a first protective layer, which is designed to be perforated by a perforating element connected to the first part by moving the first part with respect to the second part, from the first position to the second position, thus making it possible for the first and the second fluid to mix in this second position, wherein the second part comprises a receptacle having a wall comprising at least a first plastics material element and a second plastics material element and, between the two, a second protective layer.

In the description, the use of the word "fluid" refers to products such as liquids, gases, powders and pastes.

By virtue of the device according to the present invention, two fluids can be packaged so as to be separated in a first position of the device. The second part at least of the receptacle includes a wall having a plastics material element forming the outside of the receptacle, wherein said wall is provided with a second protective layer.

This second protective layer, associated with the first protective layer which closes the receptacle, provides ideal packing of the product contained in the second part. This means that the quality of the product present in the second part remains optimal, since it is not altered while the device according to the invention is in storage.

In accordance with a preferred embodiment, the first part of said package is provided with a substantially cylindrical outer wall, which at one end is designed to receive, in the inside thereof, the second part of the device.

In accordance with a preferred embodiment, the wall of the second part comprises a first plastics material element and a second plastics material element and, between the two, the second protective layer.

In accordance with a preferred embodiment, the first element, the second protective layer and the second element of the second part are obtained by an over-moulding process.

In accordance with a preferred embodiment, the second protective layer between the first element and the second element of the second part comprises aluminium.

In accordance with a preferred embodiment, the second protective layer between the first element and the second element of the second part comprises a multi-layer construction of polyolefin, aluminium and polyolefin.

In accordance with a preferred embodiment, the first part of said package is provided with a substantially cylindrical outer wall, which at one end is designed to receive in the inside thereof, the second part of the device.

In accordance with a preferred embodiment, the breakable element is designed to be moved by means of the striking element from a first position to a second position to a second position, and wherein, in this second position, the breakable element is connected to the first part of the device over at least part of the circumference thereof.

In accordance with a preferred embodiment, the breakable element of the first part and the striking element connected to the second part are designed to keep the breakable element in the second, open position thereof so as to prevent the first part from re-closing in this second position.

In accordance with a preferred embodiment, the breakable element of the first part, the striking element connected to the second part, the first protective layer of the second part and the perforating element connected to the first part are designed to make it possible for the device, in that the first part of said device is moved with respect to the second element from the first position of said part and element to the second position thereof, to start to perforate the first protective layer by means of the perforating element before the striking element comes into contact with the breakable element.

In accordance with a preferred embodiment, the first part of the device is designed to package a liquid and wherein the second part is designed to package a powder.

A second aspect of the invention relates to a method for obtaining a device for packaging a first fluid and a second fluid which cannot be mixed before handling, wherein said method comprises the step of producing a first part of the device to contain a first product, wherein this first part includes an element in the form of a breakable element which is designed to be moved from a first position to a second position, by means of a perforating element, thus releasing in this second position the fluid contained in this first part, and wherein the method comprises the following steps:

- producing, by a plastics material injection process, a first element to form a second part of the device designed to contain a second fluid,
- forming, by a cold-forming process, a second protective layer designed to be connected to the first element of the second part,
- introducing the first element of the second part and the second protective layer into a mould,
- producing, by an "over-moulding" process, a second element which, together with the first element and the second protective layer, is designed to form the second part of the device.

In accordance with a preferred embodiment, the second protective layer, positioned between the first element and the second element of the second part, contains aluminium.

In accordance with a preferred embodiment, the second protective layer contains polyolefin and aluminium.

The present invention and the advantages thereof will be better understood upon reading the following description, which makes reference to the drawings, in which:

FIG. 1 shows a device 10 according to the present invention for packaging two products separately, wherein said device 10 is designed to make it possible to mix these two products at a time of the user's choosing.

Figure 1:
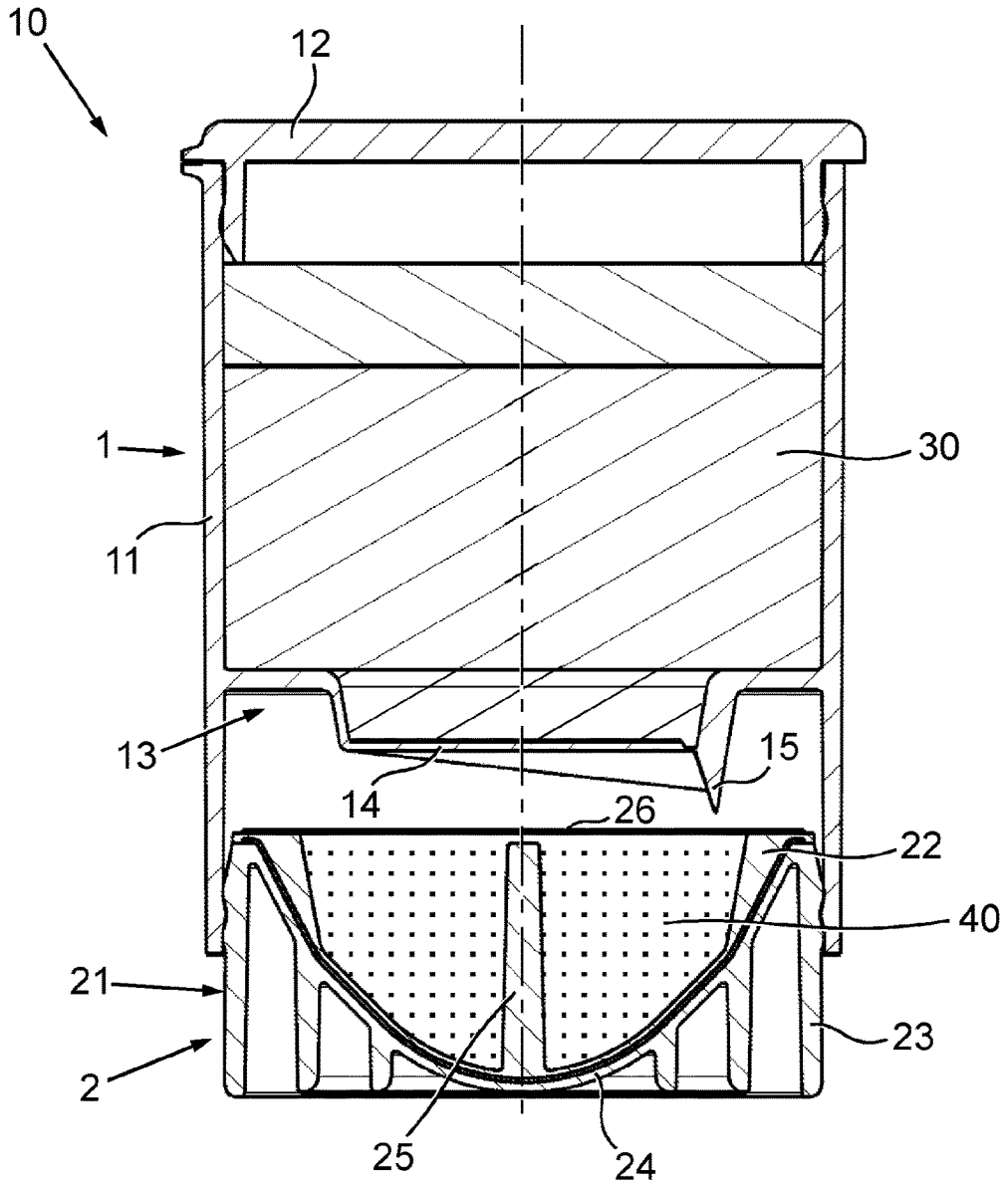
FIG. 1 is a sectional view of an embodiment of the device according to the invention in a first position prior to handling.
Figure 4:
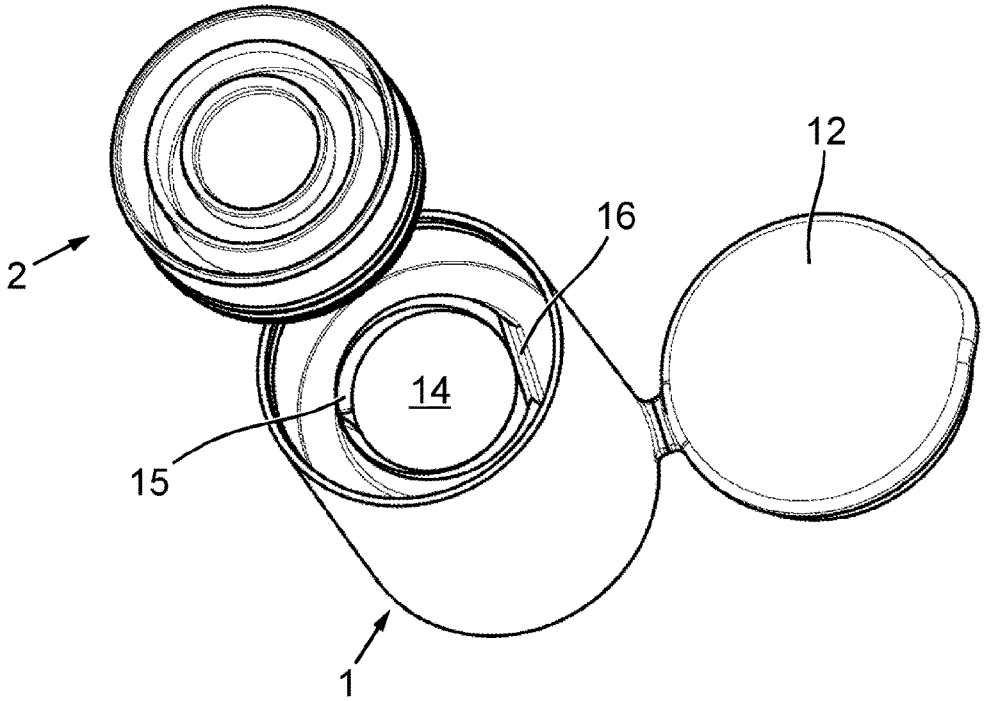
FIG. 4 is a perspective view of the first part and the second part of the device according to FIGS. 1 and 2, prior to assembly.

The device 10 comprises a first part 1 and a second part 2. The first part 1 is designed to contain a first fluid, such as a liquid 30. The first part 1 is provided with a wall 11, for example of a cylindrical shape. A first end is closed by a stopper 12. As is shown in FIG. 4, the stopper 12 is connected to the walls 11 and can be moved from a closed position, as shown in FIG. 1, to an open position, as shown in FIG. 4, so as to release the contents of the device 10 when the two products inside said device 10 are mixed.

Figure 2:
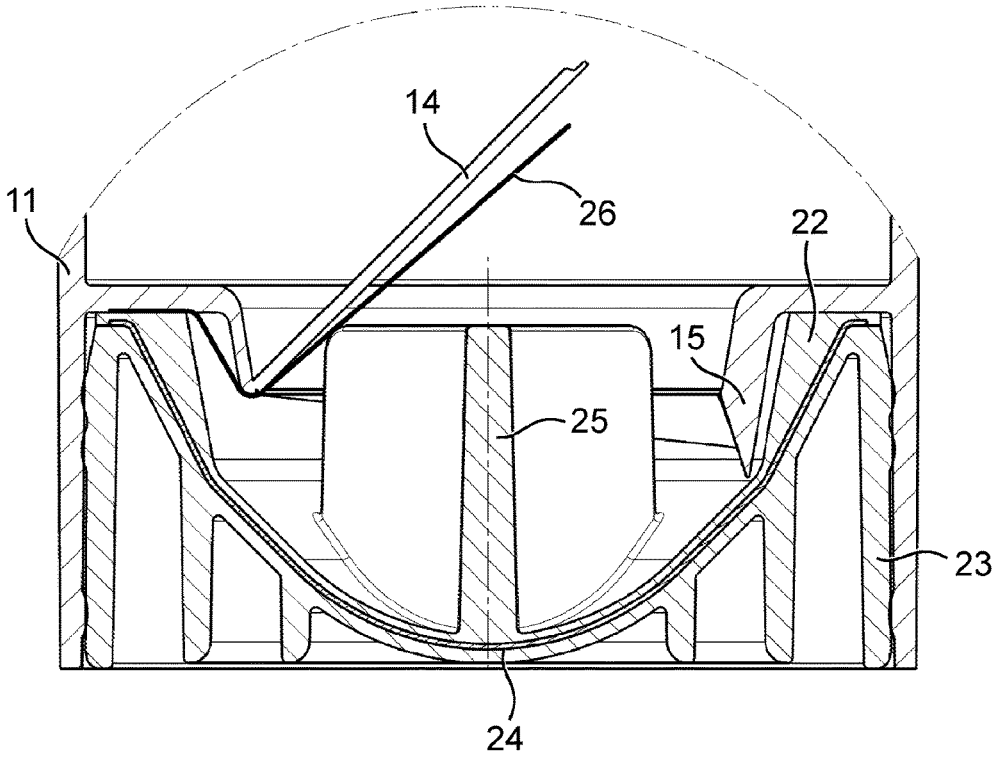
FIG. 2 is a sectional view of part of the device according to FIG. 1 in a second position after handling.

The wall 11 includes a closing element 13 for closing, on the opposite side, the compartment for containing the liquid 30. This element 13 includes a wall 14, in the form of a breakable element, which can be moved from a starting position, as shown in FIG. 1, and in which the wall 14 is designed to contain the liquid 30 in the first part 1, to an in-use position, as shown in FIG. 2, in which the wall 14 makes it possible for the fluid 30 to mix with the product contained in the second part 2.

The closing element 13 of the first part 1 is thus provided with a perforating element 15. This perforating element 15 is directly connected to the inside of the wall 11 of the first part 1. The perforating element 15 is designed to perforate the element which protects the product contained in the second part 2, and makes it possible to open this protection so as to allow the two products contained in the device 10 to mix.

It should be noted that the first part 1 may be designed to be packed in aseptic environments. Moreover, the first part 1 must be designed to keep the contents 30 sterile inside the first part 1.

FIG. 1 also shows the second part 2 which is designed to contain the fluid such as a powder 40. The second part is provided with an outer wall 21, which in turn is designed to be received on the inside of the wall 11 of the first part 1. The dimensions of the wall 21 and of the wall 11 are defined so as to provide perfectly sealing contact between the inside of the wall 11 and the outside of the wall 21, whether before, during or after the mixing of the products contained in the first part 1 and the second part 2.

As is shown in greater detail in FIG. 2, the second part 2 comprises a first element 22 and a second element 23. A protective layer 24 is affixed between the first element 22 and the second element 23. The presence of this protective layer 24 is of particular importance, since it ensures that the powder 40 is packed inside the second part 2. The protective layer 24 provides impermeability to oxygen $O_2$ and $H_2O$.

The protective layer 24 may contain an aluminium sheet and may be in the form of a multi-layer construction of polyolefin and aluminium, for example a first layer of polyolefin, a second layer of aluminium and a further layer of polyolefin.

Figure 5:
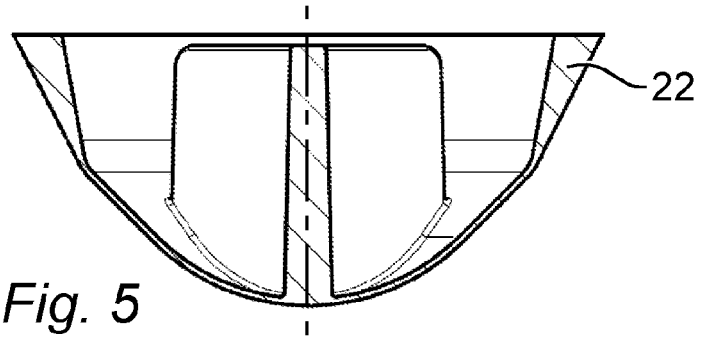
FIG. 5 shows the first step in the production of the second part of the device according to FIGS. 1 and 2.
Figure 6:
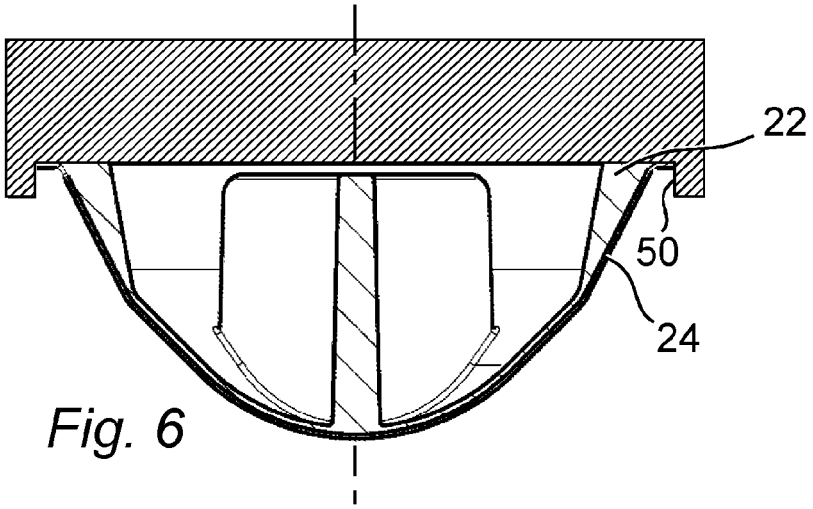
FIG. 6 shows the second step in the production of the second part of the device according to FIGS. 1 and 2.
Figure 7:
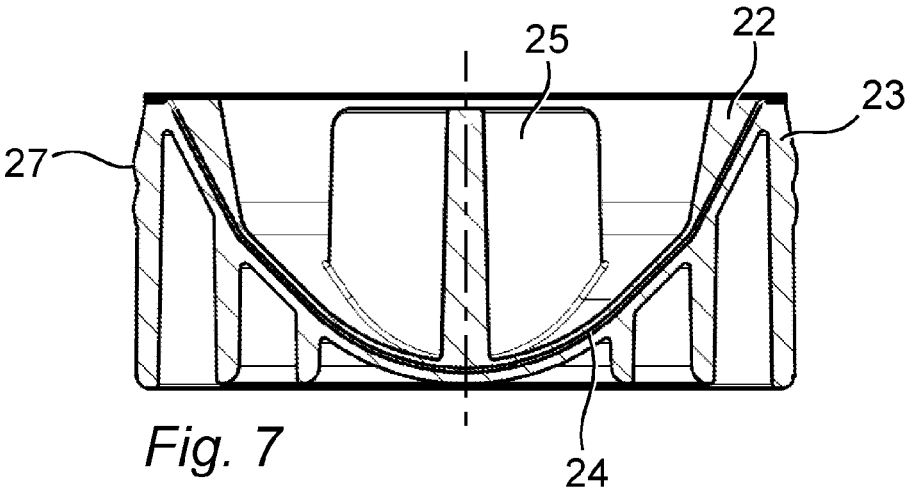
FIG. 7 shows the final step relating to the production of the second part of the device according to FIGS. 1 and 2.

One embodiment for producing the second part 2 is disclosed with reference to FIGS. 5, 6 and 7.

As is shown in FIG. 1, the second part 2 is provided with a striking element 25. The striking element 25 is connected to the lower walls of the second part 2 and can exert a pressure on the wall 14, having the form of a breakable element, so as to make it possible for this wall 14, having the form of a breakable element, to be moved from its starting position to its in-use position, as shown in FIG. 2.

For optimum packing of the second product, in the form of a powder 40, inside the second part 2, this second part 2 is provided with a protective layer, for example an aluminium sheet 26.

The operation of the device 10 according to the present invention will be better understood upon comparing FIGS. 1 and 2. In FIG. 1, the first product, in the form of a liquid 30, is contained in the first part 1. Packing of the liquid 30 inside the first part 1 is ensured by the combination of walls 11, the stopper 12 and the closing element 13. By virtue of these various elements, the liquid 30 located in the first part 1 fully maintains its integrity.

Simultaneously, the second product, in the form of a powder 40, is packed in an optimal manner in the second part 2, using the various elements 22 and 23 of this second part 2 in combination with the protective layers 24 and 26. As is shown in FIG. 1, the two products 30 and 40 are contained in the device 10 without any mixing between the two products being possible.

So as to release the products 30 and 40, thus making mixing possible between the two parts, the user has to press on the first part and on the second part so as to cause the second part 2 to be received inside the wall 11. This movement of the first part with respect to the second part can be achieved by placing the second part on a support, then pressing on the stopper 12. Any other suitable method may be used to ensure that the second part penetrates the wall 11.

When the second part 2 has penetrated the wall 11 of the first part 1, the situation shown in FIG. 2 is obtained. The movement of the first part 1 with respect to the second part 2 has had the effect of perforating the protective layer 26 by virtue of the perforating element 15.

As is shown in FIG. 2, in combination with FIG. 4, the perforating element 15 has been shaped to cut part of the periphery of the protective layer 26. In other words, the protective layer 26 remains fixed, in part, to the second part 2.

In order to provide this operation, the perforating element 15 may be in the form of a collar for opening three quarters of the periphery of the protective layer 26. By maintaining the connection of the remaining quarter of the periphery of the protective layer 26 to the second part 2, penetration of said protective layer 26 inside the first part 1, thus forming an obstacle, is prevented.

Furthermore, the partial connection provided between the protective layer 26 and the second part 2 makes it possible to prevent this protective layer from being discharged from the device 10, thus releasing the mixture out of the device 10.

At the same time as the perforating element 15 perforates the protective layer 26, the wall in the form of a breakable element 14 is moved, by means of the striking element 25, from the initial position thereof, as shown in FIG. 1, to the in-use position thereof, as shown in FIG. 2.

Similarly to the protective layer 26, this wall 14 in the form of a breakable element remains, over part of the periphery thereof, connected to the first part of the device 10. This means that, after the first part 1 has moved with respect to the second part 2, the wall 14 cannot under any circumstances become an obstacle inside the device 10 according to the invention, nor can it be discharged from said device 10.

When the second part 2 has penetrated inside the wall 11 of the first part 1, as shown in FIG. 2, the two products 30 and 40 can come into contact so as to obtain a mixture of these two products 30 and 40.

So as to obtain optimal mixing of the liquid 30 and the powder 40, the device 10 can be shaken before opening the stopper 12, thereby releasing the mixture 30/40 from the device 10.

Figure 3:
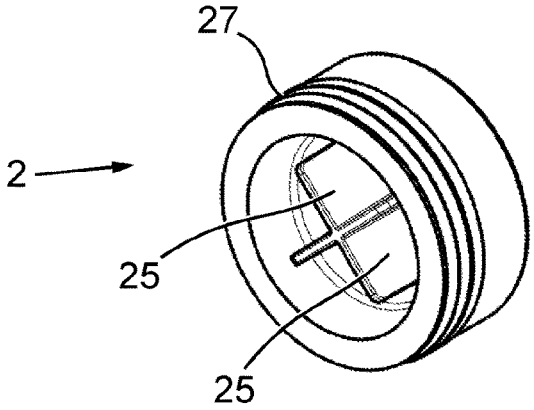
FIG. 3 is a perspective view of the second part of the device according to FIGS. 1 and 2.

FIG. 3 shows the second part 2 of the device 10 according to the present invention. This FIG. 3 shows in detail the striking element 25, which is substantially in the form of a cross having four limbs.

FIG. 3 also shows that the second part 2 is provided, on the outside thereof, with grooves 27 designed to cooperate with grooves on the inside of the wall 11, ensuring the sealing between the first part 1 and the second part 2, once the two products inside the device 10 are allowed to mix.

FIG. 4 shows the device 10 prior to assembly, and makes it possible to describe the base of the first part 1, and more specifically the shape of the perforator 15. As is shown in FIG. 4, the perforator 15 is substantially in the form of a collar. It does not form a continuous circle, but is provided with a sector 16 having two functions.

The first function of the sector 16 is to provide perforation of the protective sheet 26, limited to three quarters of the periphery thereof, by pressing on the perforator 15. At the point where the sector 16 is located, the protective layer 26 is maintained and is not altered.

The other function of the sector 16 is to keep the element 14 in the form of a breakable element fixed to the walls 11 of the first part 1 after it is opened.

FIGS. 5, 6 and 7 show in detail, step by step, the method for manufacturing the second part 2 of the device according to the present invention.

As is shown in FIG. 5, the first element 22 of the second part 2 is obtained by a plastics material injection process, carried out for example using a rotary or transfer mould. As is clearly shown in FIG. 5, the first element 22 comprises, inter alia, the striking element 25.

The second part of the process is shown in FIG. 6. The protective sheet 24 is shaped by a cold-forming process and subsequently mounted, by a robot, on the first element 22. As stated previously, the protective layer 24 may comprise any suitable material, but is preferably formed of a multilayer construction of polyolefin, then aluminium, then more polyolefin. The protective layer 24 is held, by diametral clamping, by the mould 50 on the first element 22 of the second part 2.

The second element 23 is formed by a second plastics material injection using an "over-moulding" process. This process enables chemical and mechanical gluing between the first element 22 and the second element 23 of the second part 2. This means that a perfect connection is provided between the first element 22 and the second element 23, and that the protective sheet 24 is fixed correctly. When the second part 2 according to FIG. 7 is obtained, the space inside this second part 2 may be used for placing a powder 40 therein. When the powder 40 is received in the second element 2, said element may be closed using the protective layer 26. In other words, this powder 40 is protected by a perfectly tight layer which is resistant to the introduction of oxygen or $H_2O$.

An advantage of the device 10 according to the present invention lies is the fact that the first part 1 and the second part 2 may be prepared individually prior to assembly. The two receptacles 1 and 2 may be packed in different environments, thus potentially being specific to one (the liquid) or other (the powder) of the products contained in the two receptacles.

The invention claimed is:

1. A device comprising:

a first part for packaging a fluid, the first part comprising:
- a fluid receptacle for storing the fluid;
- a breakable element disposed on a bottom side of the fluid receptacle;
- a perforating element disposed about at least a portion of a periphery of the breakable element; and
- a closing element secured to an inner wall of the fluid receptacle and adapted to support the perforating element and the breakable element;

a second part for packaging a substance, the second part comprising;
- a substance receptacle for storing the substance;
- a first protective layer disposed over an opening of the substance receptacle; and
- a striking element disposed within the substance receptacle and beneath the first protective layer of the second part;

wherein the first part and the second part are securable to one another in a first position that keeps the fluid and the substance separate and a second position that allows mixing of the fluid and the substance;

wherein, in the first position, the breakable element is on a horizontal plane that is offset from a horizontal plane of the closing element.

2. The device according to claim 1, wherein the second part comprises:
- a first plastics material element;
- a second plastics material element; and
- a second protective layer disposed between the first plastics material element and the second plastics material element.

3. The device according to claim 2, wherein the first plastics material element, the second protective layer, and the second plastics material element of the second part are obtained by an over-moulding process.

4. The device according to claim 2, wherein the second protective layer comprises aluminum.

5. The device according to claim 2, wherein the second protective layer comprises a multi-layer construction of at least one of polyolefin and aluminum.

6. The device according to claim 1, wherein the first part comprises a substantially cylindrical outer wall, which substantially cylindrical outer wall at one end is designed to receive the second part of the device.

7. The device according to claim 1, wherein the first protective layer for protecting the substance inside the second part contains aluminum.

8. The device according to claim 1, wherein, responsive to the device being in the second position, the striking element extends into the fluid receptacle and displaces the breakable element towards a top side of the first part.

9. The device according to claim 8, wherein the breakable element is a wall and wherein, responsive to the device being in the second position, the wall and the striking element are designed to keep the wall in the second position so as to prevent the first part from re-closing in the second position.

10. The device according to claim 1, wherein the perforating element is disposed a first distance from the first protective layer and the striking element is disposed a second distance from the breakable element, the second distance being greater than the first distance so that the first protective layer is perforated by the perforating element before the striking element contacts the breakable element.

11. The device according to claim 1, wherein the fluid is a liquid and wherein the substance is a powder.

12. The device of claim 1, wherein the perforating element is a collar that is adapted to open three quarters of a periphery of the first protective layer.

13. The device of claim 1, wherein the breakable element is a wall and wherein, responsive to the device being placed into the second position, the striking element displaces the first protective layer and the wall away from the second part.

14. The device of claim 1, wherein the breakable element is disposed above the opening of the substance receptacle.

15. A device comprising:

a first compartment for packaging a first substance, the first compartment comprising:
- a first end comprising a first opening;
- a second end comprising a second opening;
- a perforating element disposed about at least a portion of a periphery of the second opening;
- a breakable element that covers the second opening; and
- a closing element secured to an inner wall of the first compartment and adapted to support the perforating element and the breakable element;

a second compartment for packaging a second substance, the second compartment comprising:
- a first protective layer covering an opening of the second compartment;
- a first plastics material element that defines an interior space within the second compartment; and
- a striking element attached at a first end to a bottom portion of the second compartment and extending upwards towards the breakable element and the first protective layer;

wherein the first compartment and second compartment are securable to one another in a first position that keeps contents of the first and second compartments separate and a second position that allows mixing of the contents of the first and second compartments; and wherein, in the first position, the breakable element is on a horizontal plane that is offset from a horizontal plane of the closing element.

16. The device of claim 15, wherein the second compartment further comprises:
- a second plastics material element; and
- a second protective layer disposed between the first and second plastics material elements.

17. The device of claim 15, wherein the breakable element is disposed above the opening of the second compartment.

18. The device of claim 15, wherein, responsive to the device being placed into the second position, the striking element displaces the first protective layer and the breakable element towards the first opening.

19. The device of claim 1, wherein, in the second position, the striking element pushes the breakable element to move the breakable element from a closed position to an open position that allows mixing of the fluid and the substance.

20. The device of claim 1, wherein, in the second position, the striking element maintains open the breakable element to allow mixing of the fluid and the substance.

* * * * *